US011926500B2

(12) United States Patent
Kishimoto et al.

(10) Patent No.: US 11,926,500 B2
(45) Date of Patent: Mar. 12, 2024

(54) SHEET FOLDING DEVICE AND SHEET POST-PROCESSOR PROVIDED WITH THE SAME

(71) Applicant: KYOCERA Document Solutions Inc., Osaka (JP)

(72) Inventors: Tadahisa Kishimoto, Osaka (JP); Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/066,449

(22) Filed: Dec. 15, 2022

(65) Prior Publication Data

US 2023/0192437 A1 Jun. 22, 2023

(30) Foreign Application Priority Data

Dec. 22, 2021 (JP) ..... 2021-207669

(51) Int. Cl.
*B65H 45/20* (2006.01)
*B65H 37/06* (2006.01)
*B65H 45/16* (2006.01)

(52) U.S. Cl.
CPC ..... *B65H 45/162* (2013.01); *B65H 37/06* (2013.01); *B65H 2801/27* (2013.01)

(58) Field of Classification Search
CPC ..... B65H 37/06; B65H 45/18; B65H 45/20; B41L 43/06
USPC ..... 270/32; 493/416, 442, 443, 444, 445
See application file for complete search history.

(56) References Cited

U.S. PATENT DOCUMENTS

| | | | | |
|---|---|---|---|---|
| 4,985,013 | A * | 1/1991 | van der Werff | B65H 45/18 493/437 |
| 5,092,833 | A * | 3/1992 | King | B65H 45/18 493/431 |
| 6,074,332 | A * | 6/2000 | Helmstadter | B65H 45/18 493/437 |
| 6,881,181 | B2 * | 4/2005 | Brown | B65H 45/18 493/419 |
| 8,257,238 | B2 * | 9/2012 | Eijkelkamp | B65H 45/18 493/434 |
| 9,108,821 | B2 * | 8/2015 | Nakada | B65H 45/12 |
| 9,533,853 | B2 * | 1/2017 | Nakagawa | B65H 45/14 |
| 9,643,813 | B2 * | 5/2017 | Kugimiya | B65H 45/18 |

(Continued)

FOREIGN PATENT DOCUMENTS

JP 2017-132572 A 8/2017

*Primary Examiner* — Leslie A Nicholson, III
(74) *Attorney, Agent, or Firm* — Stein IP, LLC

(57) ABSTRACT

A sheet folding device includes a sheet conveyance path, a first folding conveyance path, a first folding roller pair, a first folding guide, and a conveyance roller. The first folding roller pair is composed of a first roller and a second roller forming a first folding nip by being brought into pressure contact with an upstream side of the first roller. The first folding guide is movable between a folding position at which it approaches the first folding nip, guiding a to-be-folded part of a sheet to the first folding nip, and a retracted position at which it is away from the first folding nip. The conveyance roller forms, together with the second roller, a first assist roller pair that conveys the sheet along the sheet conveyance path. The first folding guide has a pivot fulcrum on a downstream side relative to the first folding nip in the conveyance direction.

6 Claims, 11 Drawing Sheets

(56) References Cited

U.S. PATENT DOCUMENTS

| | | | | |
|---|---|---|---|---|
| 10,087,035 | B2 * | 10/2018 | Hama | B65H 45/14 |
| 11,560,286 | B2 * | 1/2023 | Murata | B65H 29/58 |
| 2012/0071310 | A1 * | 3/2012 | Satoh | B65H 45/144 493/442 |

* cited by examiner

SHEET FOLDING DEVICE AND SHEET POST-PROCESSOR PROVIDED WITH THE SAME

INCORPORATION BY REFERENCE

This application is based upon and claims the benefit of priority from the corresponding Japanese Patent Application No. 2021-207669 (filed on Dec. 22, 2021), the entire contents of which are incorporated herein by reference.

BACKGROUND

The present disclosure relates to a sheet folding device that performs a folding process of forming a fold line on a sheet and to a sheet post-processor provided with the same.

There is known a sheet post-processor provided with a sheet folding device that performs a folding process of forming a fold line on a sheet after being subjected to image formation by an image forming apparatus such as a copy machine or a printer.

SUMMARY

A sheet folding device according to an aspect of the present disclosure includes a sheet conveyance path, a first folding conveyance path, a first folding roller pair, a first folding guide, and a conveyance roller and performs a folding process with respect to a sheet. The sheet is conveyed on the sheet conveyance path. The first folding conveyance path extends to intersect with the sheet conveyance path. The first folding roller pair is composed of a first roller and a second roller configured to form a first folding nip by being brought into pressure contact with an upstream side of the first roller in a conveyance direction of the sheet conveyed on the sheet conveyance path. The first folding roller pair folds in two the sheet passing through the first folding nip and conveys the folded sheet to the first folding conveyance path branching and extending from the sheet conveyance path. The first folding guide is disposed to be opposed to the first folding nip with the sheet conveyance path interposed therebetween and reciprocates between a folding position at which the first folding guide approaches the first folding nip to guide a to-be-folded part of the sheet conveyed on the sheet conveyance path to the first folding nip and a retracted position at which the first folding guide is away from the first folding nip. The conveyance roller makes pressure contact with the second roller so as to form, together with the second roller, a first assist roller pair that conveys the sheet along the sheet conveyance path. The first folding guide has a pivot fulcrum on a downstream side relative to the first folding nip in the conveyance direction and is supported so as to be pivotable about the pivot fulcrum between the folding position and the retracted position.

DETAILED DESCRIPTION

Figure 1:
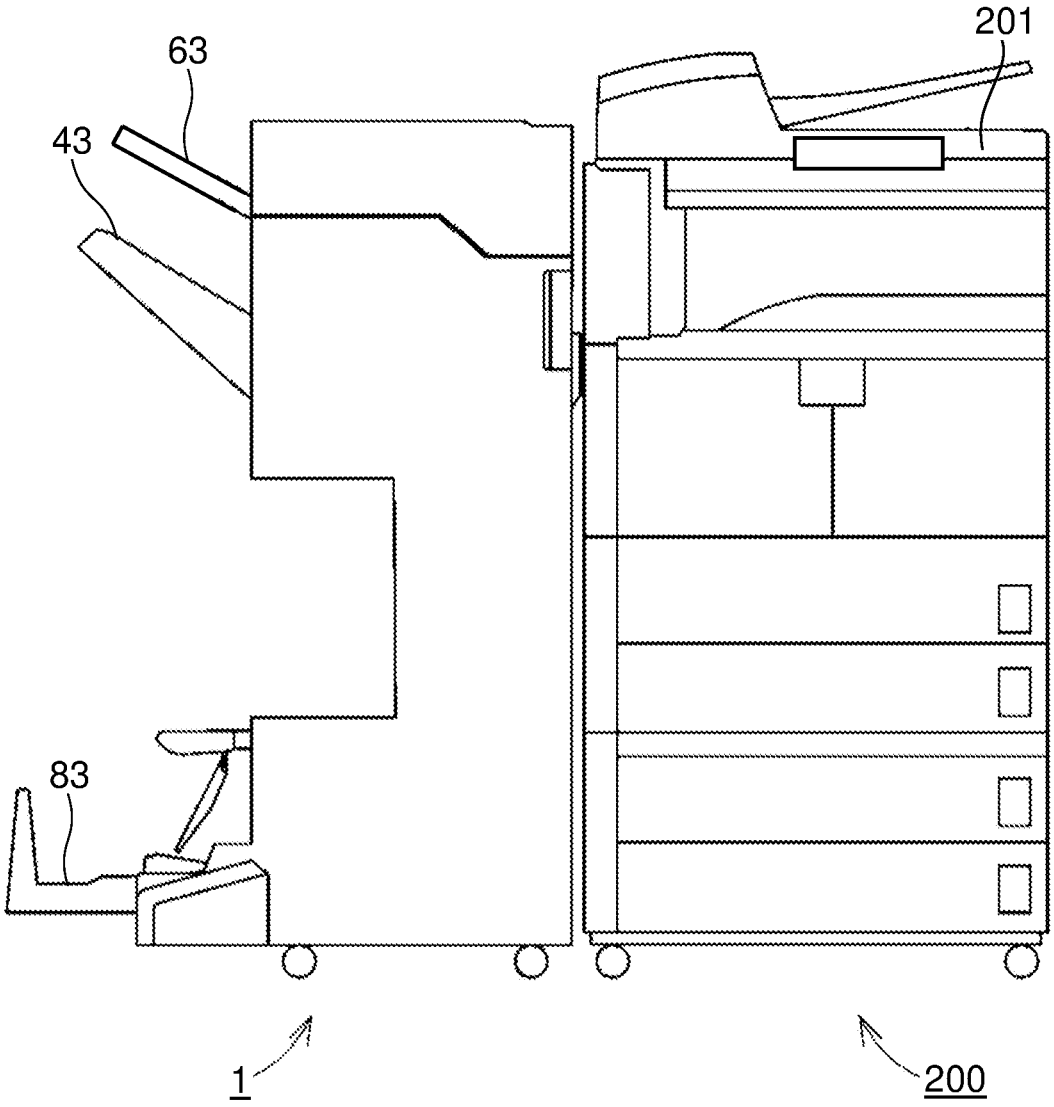
FIG. 1 is a schematic view showing a configuration of an image forming system composed of a sheet post-processor provided with a sheet folding unit according to an embodiment of the present disclosure and an image forming apparatus to which the sheet post-processor is coupled.

With reference to the appended drawings, the following describes an embodiment of the present disclosure in detail. FIG. 1 is a schematic view showing a configuration of an image forming system composed of a sheet post-processor 1 provided with a sheet folding unit 100 according to the embodiment of the present disclosure and an image forming apparatus 200 to which the sheet post-processor 1 is coupled.

As shown in FIG. 1, based on image data externally inputted via an unshown network communication portion or image data read by an image reading portion 201 disposed in an upper part of the image forming apparatus 200, the image forming apparatus 200 prints an image on a sheet (a paper sheet).

The sheet post-processor 1 is detachably coupled to a side surface of the image forming apparatus 200. The sheet post-processor 1 performs post-processing including a punch hole forming process, a binding process, a folding process, and so on with respect to a sheet after being subjected to image formation (printing) by the image forming apparatus 200. Without being limited to performing the post-processing with respect to a sheet automatically conveyed from the image forming apparatus 200, the sheet post-processor 1 itself may convey a sheet placed by a user on an unshown tray to such a position as to be able to perform the post-processing and perform the post-processing with respect to the sheet.

Figure 2:
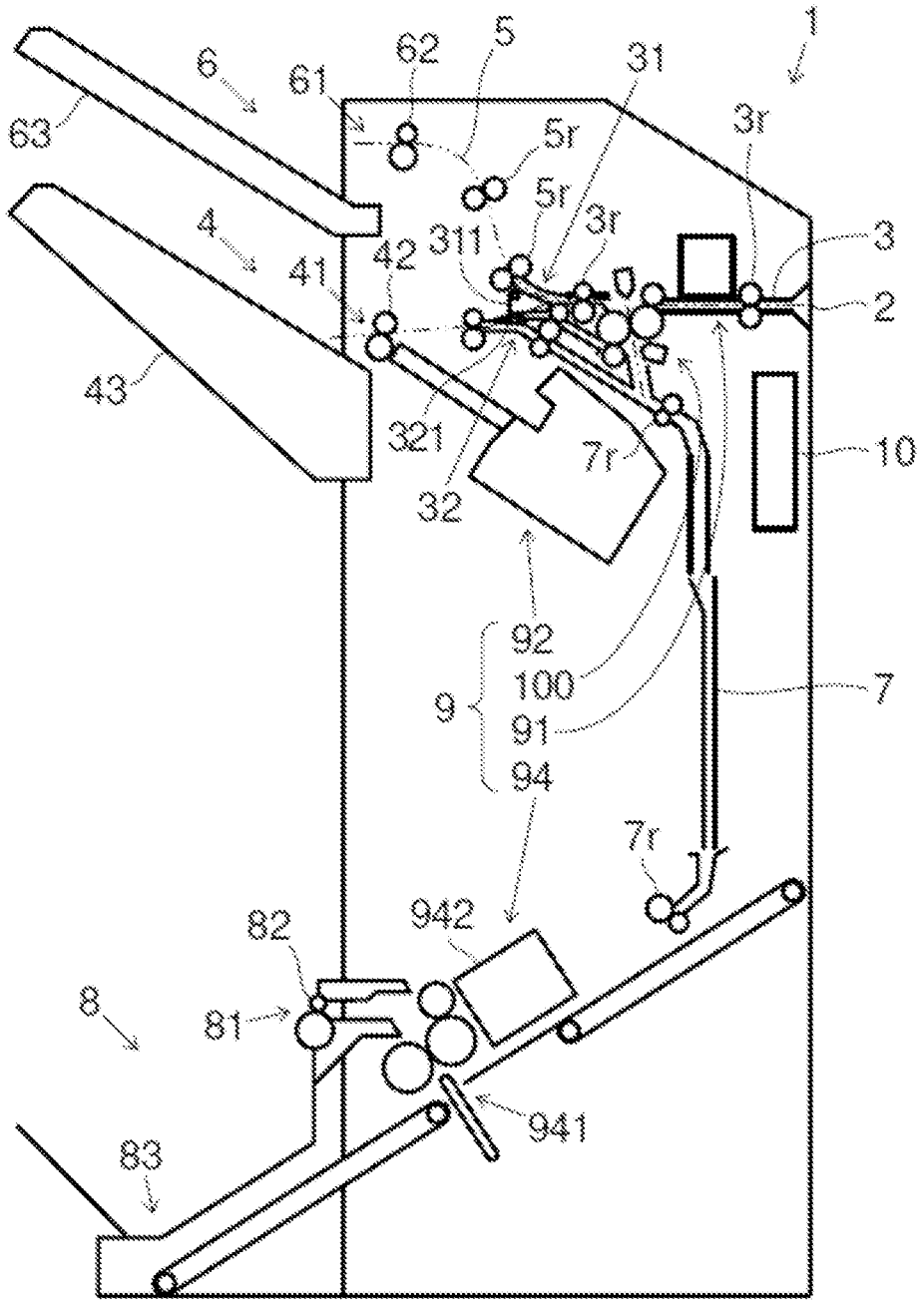
FIG. 2 is a sectional side view schematically showing a configuration of the sheet post-processor provided with the sheet folding unit of this embodiment.

FIG. 2 is a sectional side view schematically showing a configuration of the sheet post-processor 1 provided with the sheet folding unit 100 of this embodiment. As shown in FIG. 2, the sheet post-processor 1 includes a sheet conveyance inlet 2, a first sheet conveyance path 3, a first sheet discharge portion 4, a second sheet conveyance path 5, a second sheet discharge portion 6, a third sheet conveyance path 7, a third sheet discharge portion 8, a post-processing section 9, and a post-processing control portion (control portion) 10.

The sheet conveyance inlet 2 is an opening provided in a side surface of the sheet post-processor 1 opposed to the image forming apparatus 200. A sheet conveyed from the image forming apparatus 200 toward the sheet post-processor 1 passes through the sheet conveyance inlet 2 to be conveyed into the sheet post-processor 1.

The first sheet conveyance path 3 extends substantially horizontally in a direction (a leftward direction in FIG. 2) away from the image forming apparatus 200 from the sheet conveyance inlet 2 to the first sheet discharge portion 4. The direction directed from the sheet conveyance inlet 2 toward the first sheet discharge portion 4 is referred to as a sheet conveyance direction on the first sheet conveyance path 3. The sheet conveyance inlet 2 is positioned at an upstream end of the first sheet conveyance path 3 in the sheet conveyance direction. The first sheet conveyance path 3 includes a plurality of conveyance roller pairs 3*r* with which a sheet that has been conveyed into the sheet post-processor 1 through the sheet conveyance inlet 2 is conveyed toward the first sheet discharge portion 4.

The first sheet discharge portion 4 is provided on a side surface of the sheet post-processor 1 on an opposite side to the side surface thereof opposed to the image forming apparatus 200. The first sheet discharge portion 4 is disposed at a downstream end of the first sheet conveyance path 3 in the sheet conveyance direction. The first sheet discharge portion 4 includes a first discharge port 41, a first discharge roller pair 42, and a first discharge tray 43.

The first discharge port 41 is positioned at the downstream end of the first sheet conveyance path 3 in the sheet conveyance direction. The first discharge roller pair 42 is disposed at the first discharge port 41. The first discharge tray 43 is positioned on a downstream side of the first discharge port 41 in the sheet conveyance direction. By the first discharge roller pair 42, a sheet that has been conveyed on the first sheet conveyance path 3 to reach the first discharge port 41 is passed through the first discharge port 41 to be discharged on the first discharge tray 43. The first discharge tray 43 is one of final discharge locations of a sheet that has been subjected to the post-processing by the sheet post-processor 1.

The second sheet conveyance path 5 branches and extends from a first branch portion (branch portion) 31 on the first sheet conveyance path 3 laterally in the direction (the leftward direction in FIG. 2) away from the image forming apparatus 200 and upward to the second sheet discharge portion 6. The first branch portion 31 is disposed on a downstream side of a perforation portion 91 in the sheet conveyance direction on the first sheet conveyance path 3. A direction directed from the first branch portion 31 toward the second sheet discharge portion 6 is referred to as a sheet conveyance direction on the second sheet conveyance path 5. The first branch portion 31 is positioned at an upstream end of the second sheet conveyance path 5 in the sheet conveyance direction. The second sheet conveyance path 5 includes a plurality of conveyance roller pairs 5*r* with which a sheet that is conveyed on the first sheet conveyance path 3 is conveyed in a conveyance direction controlled at the first branch portion 31 to be directed toward the second sheet discharge portion 6.

The first branch portion 31 includes a first switch guide 311. The first switch guide 311 pivots to a first position (indicated by a broken line P1 in FIG. 5) for guiding a sheet that is conveyed on the first sheet conveyance path 3 from near the sheet conveyance inlet 2 to the first discharge port 41 along the first sheet conveyance path 3, and to a second position (indicated by a solid line P2 in FIG. 5) for controlling a conveyance direction of a sheet so that the sheet is guided from the first sheet conveyance path 3 to the second sheet conveyance path 5. The first switch guide 311 pivots also to a third position (indicated by a broken line P3 in FIG. 5) for guiding a sheet that has been subjected to the folding process and then passed through an after-mentioned second folding conveyance path 106 to the second sheet conveyance path 5. The first switch guide 311 is connected to a drive mechanism (not shown), and an operation thereof is controlled by the post-processing control portion 10.

The second sheet discharge portion 6 is provided on the side surface of the sheet post-processor 1 on the opposite side to the side surface thereof opposed to the image forming apparatus 200 and above the first sheet discharge portion 4. The second sheet discharge portion 6 is disposed at a downstream end of the second sheet conveyance path 5 in the sheet conveyance direction. The second sheet discharge portion 6 includes a second discharge port 61, a second discharge roller pair 62, and a second discharge tray 63.

The second discharge port 61 is positioned at the downstream end of the second sheet conveyance path 5 in the sheet conveyance direction. The second discharge roller pair 62 is disposed at the second discharge port 61. The second discharge tray 63 is positioned on a downstream side of the second discharge port 61 in the sheet conveyance direction. By the second discharge roller pair 62, a sheet that has been conveyed on the second sheet conveyance path 5 to reach the second discharge port 61 is passed through the second discharge port 61 to be discharged on the second discharge tray 63. The second discharge tray 63 is one of the final discharge locations of a sheet that has been subjected to the post-processing by the sheet post-processor 1. A sheet not to be subjected to the post-processing, a small-sized sheet, and so on are also discharged on the second discharge tray 63.

The third sheet conveyance path 7 branches and extends from a second branch portion 32 on the first sheet conveyance path 3 downward to the third sheet discharge portion 8. A direction directed from the second branch portion 32 toward the third sheet discharge portion 8 is referred to as a sheet conveyance direction on the third sheet conveyance path 7. The second branch portion 32 is positioned on a downstream side of the first branch portion 31 in the sheet conveyance direction on the first sheet conveyance path 3 and at an upstream end of the third sheet conveyance path 7 in the sheet conveyance direction. The third sheet conveyance path 7 includes a plurality of conveyance roller pairs 7*r* with which a sheet that is conveyed on the first sheet conveyance path 3 is conveyed in a conveyance direction controlled at the second branch portion 32 to be directed toward the third sheet discharge portion 8.

The second branch portion 32 includes a second switch guide 321. The second switch guide 321 pivots to a first position (see FIG. 5) for guiding a sheet that is conveyed on the first sheet conveyance path 3 from near the sheet conveyance inlet 2 to the first discharge port 41 along the first sheet conveyance path 3, and to a second position (not shown) for guiding a sheet that has been conveyed on the first sheet conveyance path 3 from near the sheet conveyance inlet 2 to pass through the second branch portion 32 and then been switched back to the third sheet conveyance path 7. The second switch guide 321 is connected to a drive mechanism (not shown), and an operation thereof is controlled by the post-processing control portion 10.

The third sheet discharge portion 8 is provided on the side surface of the sheet post-processor 1 on the opposite side to the side surface thereof opposed to the image forming apparatus 200 and below the first sheet discharge portion 4 (in a neighborhood of a lower end part of the sheet post-processor 1). The third sheet discharge portion 8 includes a third discharge port 81, a third discharge roller pair 82, and a third discharge tray 83.

The third discharge port 81 is positioned at a downstream end of the third sheet conveyance path 7 in the sheet conveyance direction. The third discharge roller pair 82 is disposed at the third discharge port 81. The third discharge tray 83 is positioned on a downstream side of the third discharge port 81 in the sheet conveyance direction. By the third discharge roller pair 82, a sheet that has been conveyed on the third sheet conveyance path 7 to reach the third discharge port 81 is passed through the third discharge port 81 to be discharged on the third discharge tray 83. The third discharge tray 83 is one of the final discharge locations of a sheet that has been subjected to the post-processing by the sheet post-processor 1.

The post-processing section 9 performs prescribed types of post-processing with respect to a sheet that has been subjected to image formation by the image forming apparatus 200 and then been conveyed into the sheet post-processor 1. The post-processing section 9 includes the perforation portion 91, a stapling portion 92, a sheet folding unit 100, and a bookbinding portion 94.

The perforation portion 91 is disposed on a downstream side of the sheet conveyance inlet 2 in immediate proximity thereto in the sheet conveyance direction on the first sheet conveyance path 3. The perforation portion 91 performs a perforation process with respect to a sheet that is conveyed on the first sheet conveyance path 3, thus forming a punch hole therein.

The stapling portion 92 is disposed on an upstream side of the first sheet discharge portion 4 in immediate proximity thereto in the sheet conveyance direction on the first sheet conveyance path 3. The stapling portion 92 performs a stapling process (the binding process) with respect to a sheet bundle formed by stacking a plurality of sheets on each other, thus binding the sheet bundle.

The sheet folding unit 100 is disposed, in the sheet conveyance direction on the first sheet conveyance path 3, on a downstream side relative to the perforation portion 91 and on an upstream side relative to the stapling portion 92. In other words, the sheet folding unit 100 is positioned on an upstream side relative to the first branch portion 31 in the sheet conveyance direction on the first sheet conveyance path 3. The sheet folding unit 100 performs the folding process with respect to a single sheet, thus forming a fold on the sheet.

The sheet folding unit 100 is capable of performing, with respect to a single sheet, the folding process such as, for example, two-folding, Z-folding, outward three-folding, or inward three-folding. A detailed configuration of the sheet folding unit 100 will be described later.

Figure 3A:
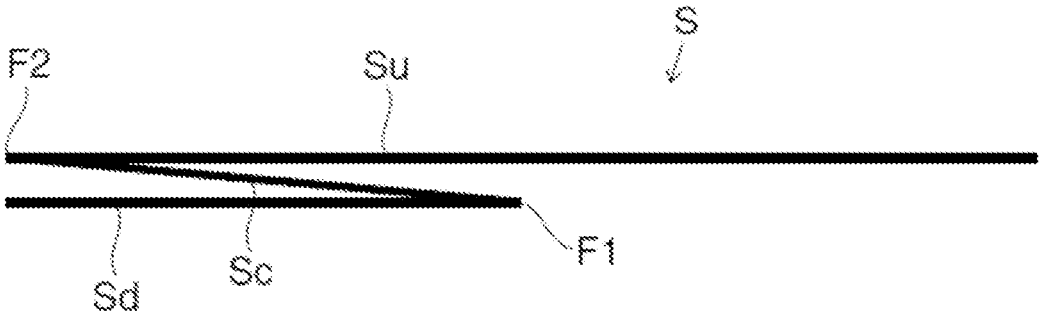
FIG. 3A is a side view of a sheet folded by a Z-folding process.
Figure 3B:
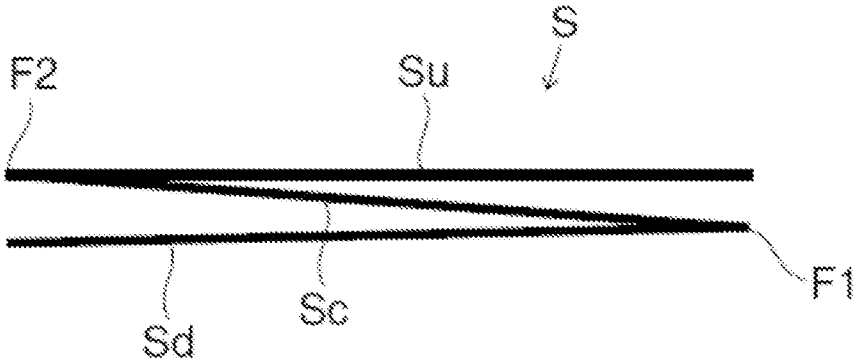
FIG. 3B is a side view of a sheet folded by an outward three-folding process.
Figure 3C:
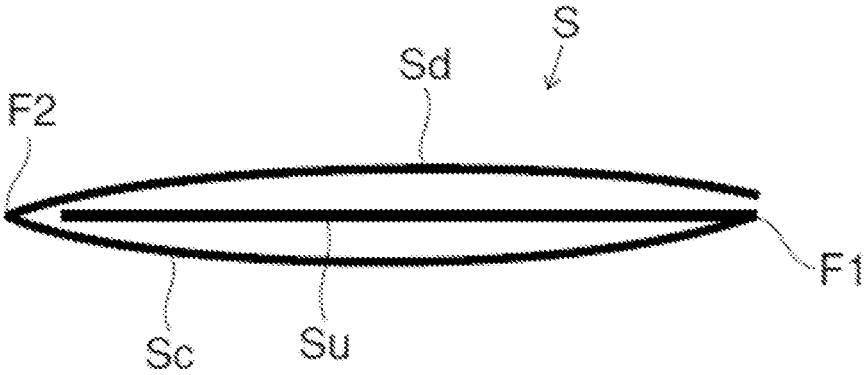
FIG. 3C is a side view of a sheet folded by an inward three-folding process.

FIG. 3A to FIG. 3C are side views of a sheet S subjected to a Z-folding process, an outward three-folding process, and an inward three-folding process, respectively.

The Z-folding refers to a way of folding the sheet S so that, for example, as shown in FIG. 3A, a downstream part of the sheet S in the sheet conveyance direction on the first sheet conveyance path 3 is folded in a shape of a letter Z as seen from a sheet width direction orthogonal to the sheet conveyance direction. In the Z-folding, on the first sheet conveyance path 3, a downstream part Sd of the sheet S on a downstream side relative to a first fold line F1 and an upstream part Su thereof on an upstream side relative to a second fold line F2 are opposed to each other in an up-down direction via a middle part Sc thereof between the two fold lines. In the sheet conveyance direction, the downstream part Sd and the middle part Sc of the sheet S are substantially equal in length and are each shorter in length than the upstream part Su thereof.

The outward three-folding refers to a way of folding the sheet S so that, for example, as shown in FIG. 3B, an entirety of the sheet S is folded in the shape of the letter Z as seen from the sheet width direction. In the outward three-folding, on the first sheet conveyance path 3, a downstream part Sd of the sheet S on a downstream side relative to a first fold line F1 and an upstream part Su thereof on an upstream side relative to a second fold line F2 are opposed to each other in the up-down direction via a middle part Sc thereof between the two fold lines. In the sheet conveyance direction, the downstream part Sd, the middle part Sc, and the upstream part Su of the sheet S are substantially equal in length.

The inward three-folding refers to a way of folding the sheet S so that, for example, as shown in FIG. 3C, in the sheet conveyance direction on the first sheet conveyance path 3, an upstream part Su of the sheet S on an upstream side relative to a first fold line F1 and a downstream part Sd thereof on a downstream side relative to a second fold line F2 are opposed to and in planar contact with each other in the up-down direction on one side (an upper side in FIG. 3C) of a plane of a middle part Sc thereof between the two fold lines.

The bookbinding portion 94 is disposed on an upstream side of the third sheet discharge portion 8 in immediate proximity thereto in the sheet conveyance direction on the third sheet conveyance path 7. The bookbinding portion 94 includes a center-folding portion 941 and a saddle-stitching portion 942. The bookbinding portion 94 performs a center-folding process and a saddle-stitching process with respect to a sheet bundle formed by stacking a plurality of sheets on each other so that the sheet bundle is bent and bound at a substantially center thereof in the sheet conveyance direction, thus forming a booklet.

The post-processing control portion 10 includes a CPU, a storage portion, and other electronic circuits and electronic components (none of which are shown). The post-processing control portion 10 is communicably connected to a main body control portion in the image forming apparatus 200 (see FIG. 1). Upon receipt of a command from the main body control portion, based on control programs and data stored in the storage portion, the post-processing control portion 10 controls operations of the various constituent elements provided in the sheet post-processor 1 by use of the CPU, so as to perform processing related to functions of the sheet post-processor 1. The first sheet conveyance path 3, the first sheet discharge portion 4, the second sheet conveyance path 5, the second sheet discharge portion 6, the third sheet conveyance path 7, the third sheet discharge portion 8, and the post-processing section 9 individually receive commands from the post-processing control portion 10 and perform the post-processing with respect to a sheet in conjunction with each other. A configuration may also be adopted in which the main body control portion in the image forming apparatus 200 also assume functions of the post-processing control portion (control portion) 10.

Figure 4:
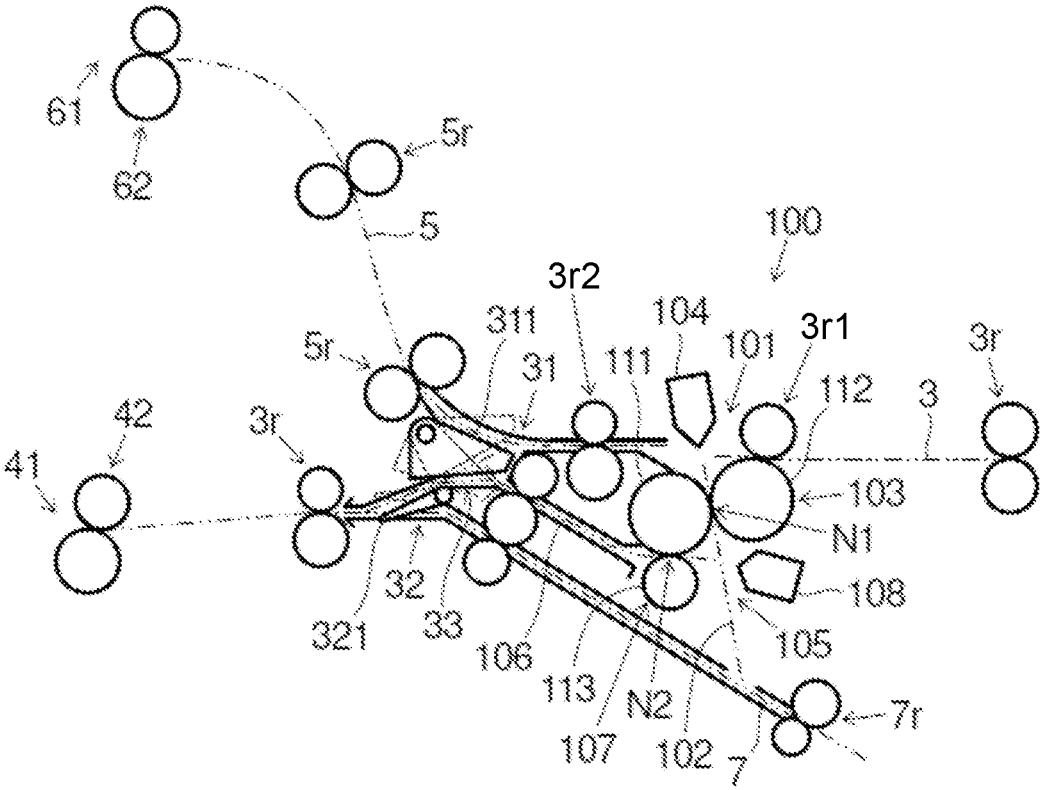
FIG. 4 is a partial sectional view showing a vicinity of the sheet folding unit in the sheet post-processor shown in FIG. 2.
Figure 5:
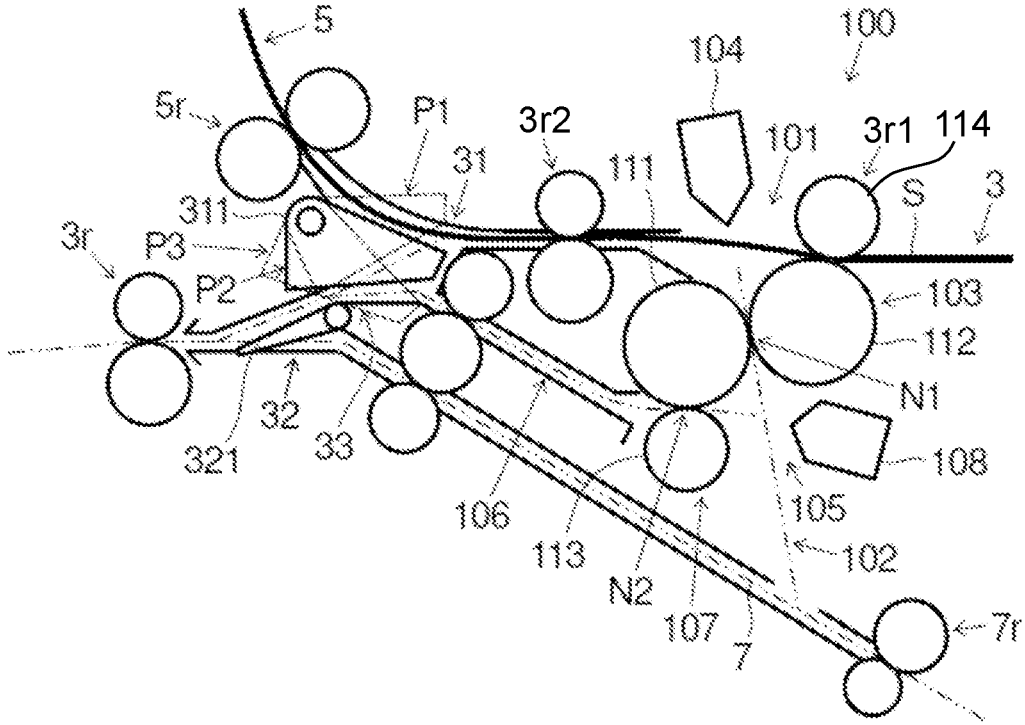
FIG. 5 is a sectional view showing the vicinity of the sheet folding unit, illustrating a first stage of transition in the inward three-folding process with respect to a sheet.

Subsequently, a description is given of a configuration of the sheet folding unit 100 with reference to FIG. 4 and FIG. 5. FIG. 4 is a partial sectional view showing a vicinity of the sheet folding unit 100 in the sheet post-processor 1 shown in FIG. 2. FIG. 5 is a sectional view showing the vicinity of the sheet folding unit 100 shown in FIG. 4. The sheet folding unit 100 includes a first folding portion 101, a first folding conveyance path 102, a first folding roller pair 103, a first folding guide 104, a second folding portion 105, the second folding conveyance path 106, a second folding roller pair 107, and a second folding guide 108.

Furthermore, the conveyance roller pairs **3*r* are disposed respectively at two different locations in the sheet folding unit 100 along the first sheet conveyance path 3. Hereinafter, of the conveyance roller pairs 3*r* disposed respectively at the two different locations in the sheet folding unit 100, an upstream one composed of a second roller 112 and a conveyance roller 114 is referred to as a first assist roller pair 3*r*1, and a downstream one is referred to as a second assist roller pair 3*r*2**.

The first folding portion 101 is disposed on the first sheet conveyance path 3. To be more specific, the first folding portion 101 is positioned on a downstream side relative to the perforation portion 91 (see FIG. 2) and on an upstream side relative to the first branch portion 31 in the sheet conveyance direction on the first sheet conveyance path 3.

The first folding conveyance path 102 branches and extends downward from the first folding portion 101 on the first sheet conveyance path 3. In this embodiment, the first folding conveyance path 102 extends downward substantially perpendicularly from the first folding portion 101. A lower end of the first folding conveyance path 102 is connected to the third sheet conveyance path 7.

The first folding roller pair 103 is disposed in the first folding portion 101 and on the first folding conveyance path 102. The first folding roller pair 103 is composed of a first roller 111 and the second roller 112 that are disposed respectively on one side and the other side with respect to the first folding conveyance path 102. One of the first roller 111 and the second roller 112 is biased toward and into contact with the other, and thus the first folding roller pair 103 forms a first folding nip N1. A sheet that has entered the first folding conveyance path 102 passes through the first folding nip N1 to be conveyed toward below the first folding roller pair 103.

Together with the conveyance roller 114, the second roller 112 constitutes the first assist roller pair **3*r*1**.

The first folding guide 104 is disposed in the first folding portion 101 so as to be opposed to the first folding nip N1 via the first sheet conveyance path 3. To be more specific, the first folding guide 104 is disposed on an upstream side (an upper side in FIG. 4) of the first folding nip N1 in a sheet conveyance direction on the first folding conveyance path 102. In a case of not performing the folding process with respect to a sheet, the first folding guide 104 is retracted in a direction away from the first folding nip N1 relative to the first sheet conveyance path 3, namely, upward relative to the first sheet conveyance path 3 in FIG. 4. Thus, a sheet passing through the first sheet conveyance path 3 makes no contact with the first folding guide 104.

The first folding guide 104 is connected to a guide drive mechanism 130 (see FIG. 15) and is reciprocatable in a direction toward or away from the first folding nip N1. The first folding guide 104 guides a sheet that is conveyed on the first sheet conveyance path 3 to the first folding nip N1.

The second folding portion 105 is disposed on the first folding conveyance path 102. To be more specific, the second folding portion 105 is positioned on a downstream side relative to the first folding roller pair 103 in the sheet conveyance direction on the first folding conveyance path 102 and on a lower side relative to the first folding nip N1.

The second folding conveyance path 106 branches and extends from the second folding portion 105 on the first folding conveyance path 102. The second folding conveyance path 106 extends from the second folding portion 105 toward near the side surface (a left side in FIG. 4) of the sheet post-processor 1 on which the first sheet discharge portion 4 is provided. In other words, the second folding conveyance path 106 extends in a substantially identical direction to an extending direction of the first sheet conveyance path 3.

The first sheet conveyance path 3 includes a merging portion 33 that is positioned on a downstream side relative to the first branch portion 31 in the sheet conveyance direction. At the merging portion 33, the second folding conveyance path 106 merges into the first sheet conveyance path 3. In other words, the merging portion 33 is positioned on a downstream side relative to the first branch portion 31 in the sheet conveyance direction on the first sheet conveyance path 3, and at the merging portion 33, a sheet that has been subjected to the folding process in the sheet folding unit 100 is introduced into the first sheet conveyance path 3.

To be more specific, in this embodiment, the merging portion 33 is positioned close to the first switch guide 311. When at the second position (a position indicated by a solid line in FIG. 4) for guiding a sheet that is conveyed on the first sheet conveyance path 3 from near the sheet conveyance inlet 2 to the second sheet conveyance path 5, the first switch guide 311 guides a sheet that has been subjected to the folding process and then been introduced into the first sheet conveyance path 3 at the merging portion 33 to near the downstream end of the first sheet conveyance path 3 in the sheet conveyance direction. When at the second position, the first switch guide 311 closes, at the merging portion 33, an upstream part of the first sheet conveyance path 3 in the sheet conveyance direction.

The second folding roller pair 107 is disposed in the second folding portion 105 and on the second folding conveyance path 106. The second folding roller pair 107 is composed of the first roller 111 and a third roller 113 that are disposed respectively on one side and the other side with respect to the second folding conveyance path 106. One of the first roller 111 and the third roller 113 is biased toward and into contact with the other, and thus the second folding roller pair 107 forms a second folding nip N2. A sheet that has entered the second folding conveyance path 106 passes through the second folding nip N2 to be conveyed toward near the merging portion 33 (a left side of the second folding roller pair 107 in FIG. 4).

The second folding guide 108 is disposed in the second folding portion 105 so as to be opposed to the second folding nip N2. To be more specific, the second folding guide 108 is disposed on an upstream side (a right side in FIG. 4) of the second folding nip N2 in a sheet conveyance direction on the second folding conveyance path 106. In the case of not performing the folding process with respect to a sheet, the second folding guide 108 is retracted in a direction away from the second folding nip N2 relative to the first folding conveyance path 102, namely, rightward relative to the first folding conveyance path 102 in FIG. 4. Thus, a sheet passing through the first folding conveyance path 102 makes no contact with the second folding guide 108.

The second folding guide 108 is connected to a drive mechanism (not shown) and is reciprocatable in a direction toward or away from the second folding nip N2. The second folding guide 108 guides a sheet that is conveyed on the first folding conveyance path 102 to the second folding nip N2.

Figure 6:
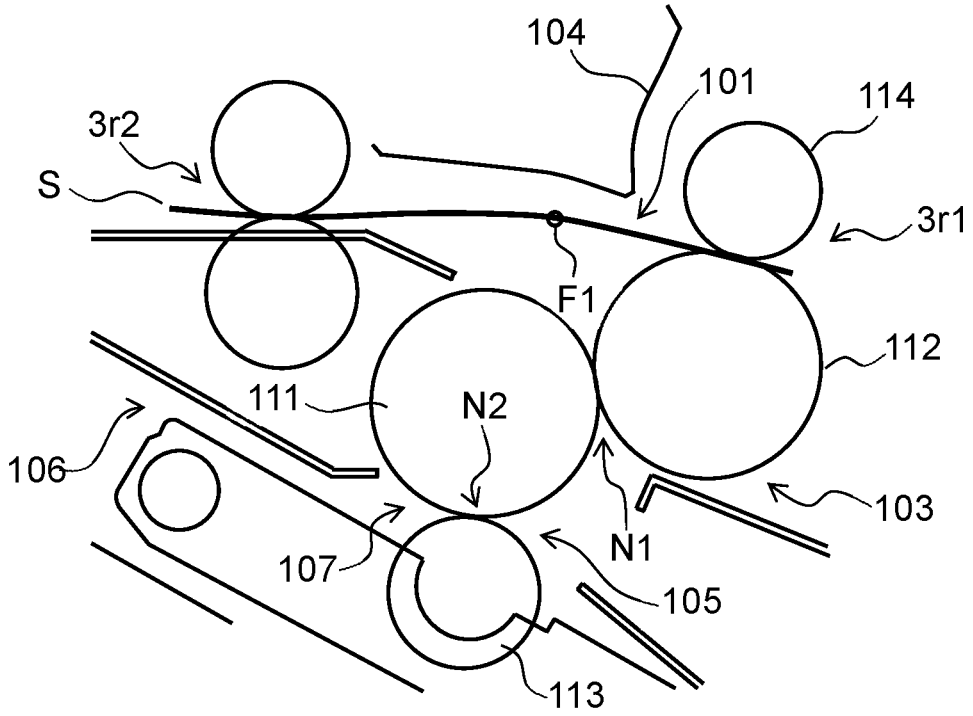
FIG. 6 is an enlarged view showing a vicinity of a first folding nip in the sheet folding unit shown in FIG. 5, illustrating a state where drawing-in of the sheet is completed at the first stage.
Figure 7:
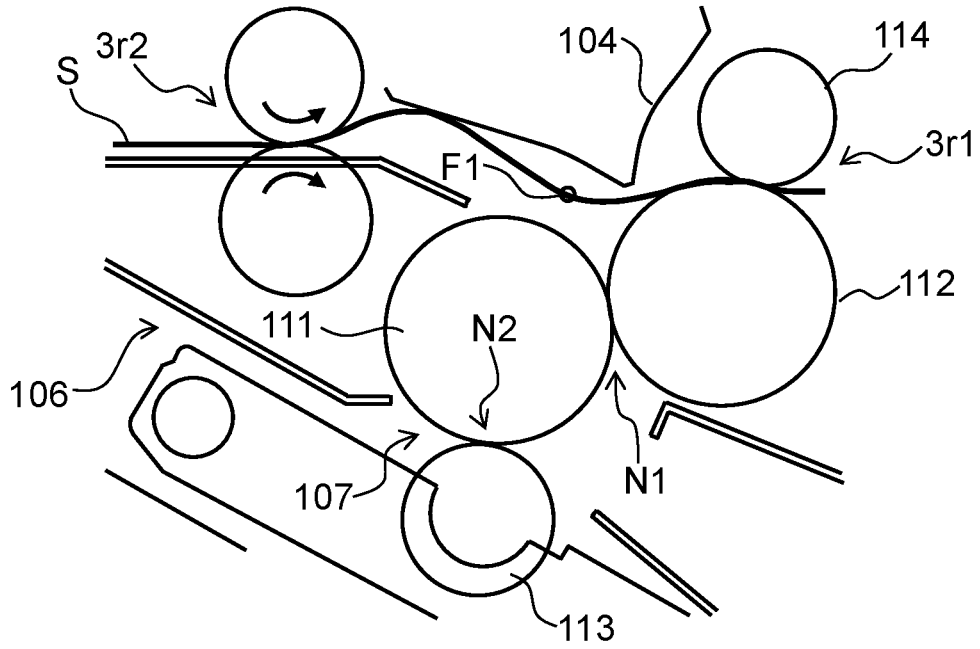
FIG. 7 is a view showing a state where a second assist roller pair is rotated reversely from the state shown in FIG. 6 so as to form a deflection in the sheet.
Figure 8:
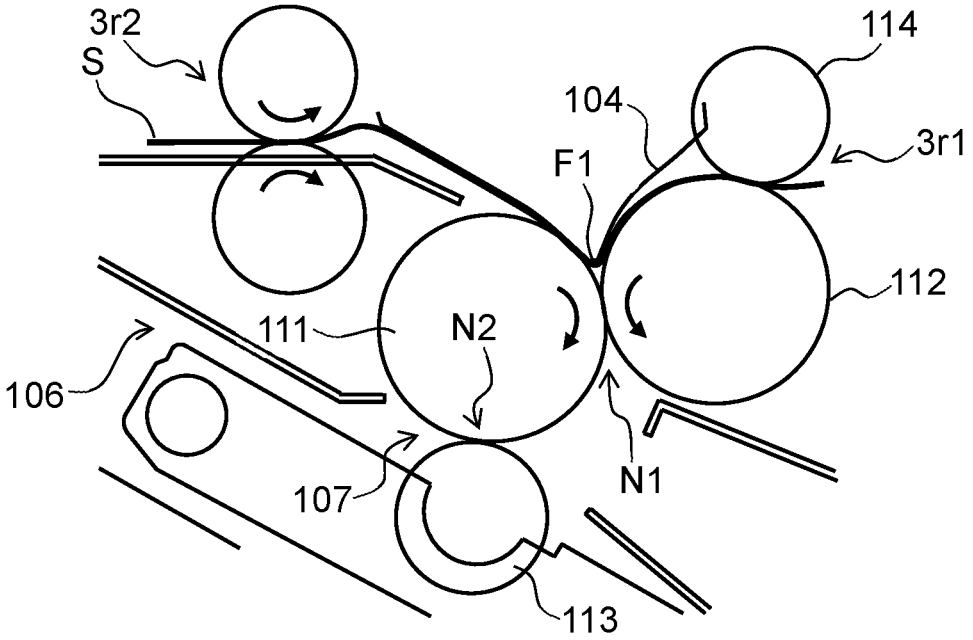
FIG. 8 is a view showing a state where the second assist roller pair is further rotated reversely from the state shown in FIG. 7 and a first folding guide is moved to a folding position so as to cause the sheet to enter the first folding nip.

Subsequently, a description is given of an operation of the sheet folding unit 100 with reference to FIG. 5 to FIG. 11. The description is directed to, as an example of the operation of the sheet folding unit 100, the inward three-folding process of inwardly folding a sheet in three as shown in FIG. 3C. FIG. 5, FIG. 9, FIG. 10, and FIG. 11 are sectional views showing the vicinity of the sheet folding unit 100 shown in FIG. 4, illustrating a first stage, a second stage, a third stage, and a fourth stage of transition in the inward three-folding process with respect to the sheet S, respectively. FIG. 6 to FIG. 8 are views showing, in more detail, the first stage in the inward three-folding process with respect to the sheet S.

As shown in FIG. 5, the sheet S is conveyed into the first sheet conveyance path 3 through the sheet conveyance inlet 2 (see FIG. 2), and a downstream part thereof in the sheet conveyance direction is guided from the first branch portion 31 to the second sheet conveyance path 5. The first switch guide 311 of the first branch portion 31 is positioned at the second position for guiding the sheet S that is conveyed on the first sheet conveyance path 3 from near the sheet conveyance inlet 2 to the second sheet conveyance path 5.

In the first folding portion 101, the first folding guide 104 is disposed at a position (a retracted position) retracted in a direction away from the first folding nip N1 relative to the first sheet conveyance path 3, namely, upward relative to the first sheet conveyance path 3 in FIG. 5.

FIG. 6 is an enlarged view showing a vicinity of the first folding nip N1 in the sheet folding unit 100 shown in FIG. 5, illustrating a state where drawing-in of the sheet S is completed at the first stage. As shown in FIG. 6, when a part of the sheet S corresponding to the first fold line F1 reaches the first folding portion 101, the first assist roller pair 3*r*1, the second assist roller pair 3*r*2, and the conveyance roller pairs 5*r* (see FIG. 4) on the second sheet conveyance path 5 are stopped from rotating to stop conveyance of the sheet S.

FIG. 7 is a view showing a state where the second assist roller pair 3*r*2 is rotated reversely from the state shown in FIG. 6 so as to form a deflection in the sheet S. As shown in FIG. 7, while the first assist roller pair 3*r*1 is stopped from rotating, the second assist roller pair 3*r*2 and the conveyance roller pairs 5*r* on the second sheet conveyance path 5 are rotated reversely, and thus a downstream part of the sheet S relative to the first assist roller pair 3*r*1 is moved to an upstream side (a right side in FIG. 7) to cause a deflection in the sheet S at the first folding portion 101. After that, the first folding guide 104 starts moving from the retracted position shown in FIG. 6 to a direction toward the first folding nip N1.

FIG. 8 is a view showing a state where the second assist roller pair 3*r*2 is further rotated reversely from the state shown in FIG. 7 and the first folding guide 104 is moved to a folding position so as to cause the sheet S to enter the first folding nip N1. As shown in FIG. 8, the second assist roller pair 3*r*2 is further rotated reversely, and the first folding guide 104 is moved to such a position (the folding position) as to contact the first folding nip N1 via the sheet S. When the first folding guide 104 moves from the retracted position to the folding position, a deflected part (a to-be-folded part) of the sheet S is guided to the first folding nip N1. As described above, the first folding guide 104 is moved to the folding position after a deflection is formed in the sheet S, and thus the sheet S is prevented from being acted upon by an excessive load from the first folding guide 104, so that it is possible to suppress wrinkle formation in the sheet S or breakage of the sheet S.

Figure 9:
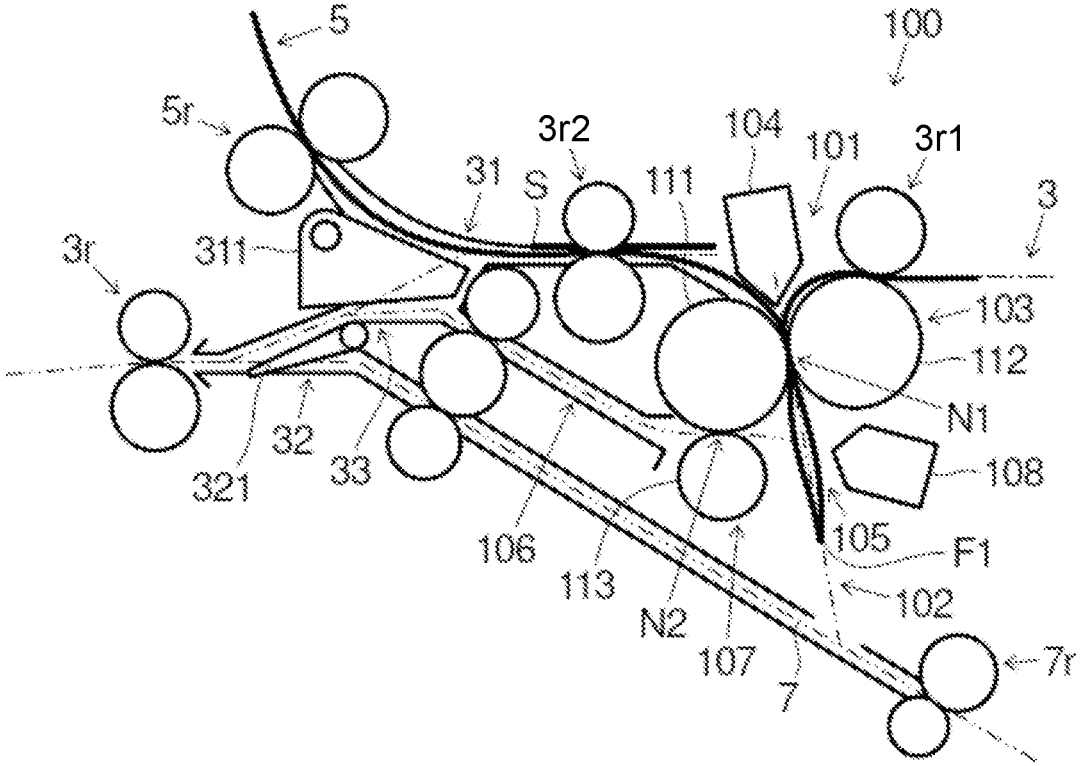
FIG. 9 is a sectional view showing the vicinity of the sheet folding unit, illustrating a second stage of transition in the inward three-folding process with respect to the sheet.

FIG. 9 is a sectional view showing the vicinity of the sheet folding unit 100, illustrating the second stage of transition in the inward three-folding process with respect to the sheet S. As shown in FIG. 9, the first fold line F1 is formed on the sheet S that has passed through the first folding nip N1.

Further, a timing for forming the first fold line F1 on the sheet S is determined based on a timing at which a downstream end of the sheet S in the sheet conveyance direction on the first sheet conveyance path 3 is detected by a sheet detection sensor (not shown), a total length of the sheet S in the sheet conveyance direction, and a conveyance speed of the sheet S. The same holds true for an after-mentioned timing for forming the second fold line F2.

Furthermore, in the second folding portion 105, the second folding guide 108 is retracted in a direction away from the second folding nip N2 relative to the first folding conveyance path 102, namely, rightward relative to the first folding conveyance path 102 in FIG. 9.

The sheet S that has passed through the first folding nip N1 is in a folded state, having two overlapping regions extending along the sheet conveyance direction with respect to the first fold line F1 as its forefront, and is conveyed in that state on the first folding conveyance path 102 in a direction (downward) away from the first folding roller pair 103. An upstream part of the sheet S in the conveyance direction, which has passed through the first folding conveyance path 102, temporarily enters the third sheet conveyance path 7.

When a part of the sheet S corresponding to the second fold line F2 (see FIG. 3C) reaches the second folding portion 105, the second assist roller pair 3*r*2, the first assist roller pair 3*r*1, the conveyance roller pairs 5*r* on the second sheet conveyance path 5, the first folding roller pair 103, and the conveyance roller pairs 7*r* on the third sheet conveyance path 7 are stopped from rotating to stop conveyance of the sheet S.

Figure 10:
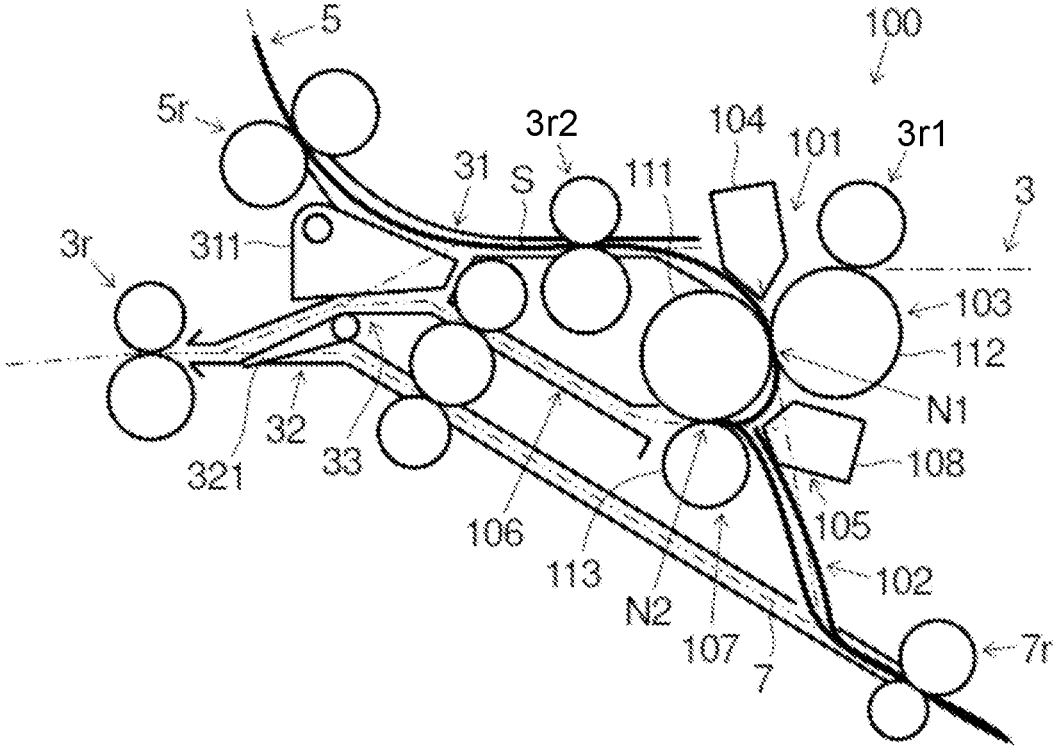
FIG. 10 is a sectional view showing the vicinity of the sheet folding unit, illustrating a third stage of transition in the inward three-folding process with respect to the sheet.

FIG. 10 is a sectional view showing the vicinity of the sheet folding unit 100, illustrating the third stage of transition in the inward three-folding process with respect to the sheet S. After the conveyance of the sheet S has been stopped, the conveyance roller pairs 7*r* on the third sheet conveyance path 7 are rotated reversely, and thus, as shown in FIG. 10, a downstream part of the sheet S (on a lower side relative to the second folding portion 105 in FIG. 10)

relative to the second folding portion 105 in the sheet conveyance direction moves to an upstream side (an upper side in FIG. 10) to cause a deflection in the sheet S at a location of the second folding portion 105.

Subsequently, the second folding guide 108 moves in a direction toward the second folding nip N2 so as to contact the sheet S. When the second folding guide 108 contacts the sheet S, as shown in FIG. 10, a deflected part (a to-be-folded part) of the sheet S is guided to the second folding nip N2 of the second folding roller pair 107. Then, the second fold line F2 is formed on the sheet S that has passed through the second folding nip N2 (see FIG. 11).

Figure 11:
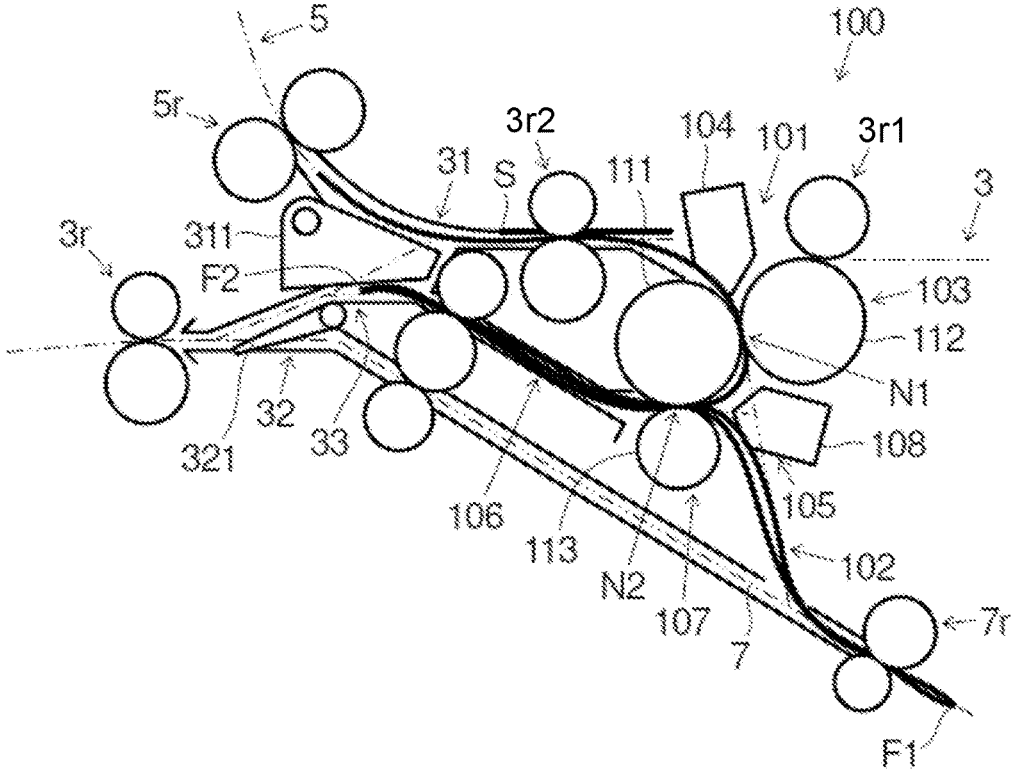
FIG. 11 is a sectional view showing the vicinity of the sheet folding unit, illustrating a fourth stage of transition in the inward three-folding process with respect to the sheet.

FIG. 11 is a sectional view showing the vicinity of the sheet folding unit 100, illustrating the fourth stage of transition in the inward three-folding process with respect to the sheet S. As shown in FIG. 11, the sheet S that has passed through the second folding nip N2 is in a folded state, having three overlapping regions extending along the sheet conveyance direction with respect to the second fold line F2 as its forefront, and is conveyed in that state on the second folding conveyance path 106 in a direction away from the second folding roller pair 107. An upstream part of the sheet S in the conveyance direction, which has passed through the second folding conveyance path 106, enters the merging portion 33. In this case, at the merging portion 33, the sheet S is guided to the first sheet conveyance path 3 by the first switch guide 311 disposed at the first position and passes through the first discharge port 41 to be discharged to the first sheet discharge portion 4 (see FIG. 2).

In a case of subjecting the sheet S to the folding process in the sheet folding unit 100, the post-processing control portion 10 performs the following control. That is, a downstream part of the sheet S in the sheet conveyance direction, which has been conveyed into the first sheet conveyance path 3 through the sheet conveyance inlet 2, is guided from the first branch portion 31 to the second sheet conveyance path 5, and then a conveyance direction of the sheet S is inverted so that the sheet S is guided to the sheet folding unit 100 and is subjected to the folding process. Moreover, the post-processing control portion 10 performs control so that, at the merging portion 33, the sheet S that has been subjected to the folding process is introduced into the first sheet conveyance path 3.

While the foregoing has described the inward three-folding process with respect to the sheet S, the Z-folding process of folding the sheet S in a Z-shape as shown in FIG. 3A and the outward three-folding process of outwardly fording the sheet S in three as shown in FIG. 3B can also be performed in an exactly similar manner to the procedure shown in FIG. 5 to FIG. 11 by changing the timings for forming the first fold line F1 and the second fold line F2 on the sheet S.

Furthermore, in a case of folding the sheet S in two, in a state where the first folding guide 104 is disposed at the folding position as shown in FIG. 8 and FIG. 9, the sheet S is conveyed into the sheet folding unit 100. Thus, a front end of the sheet S is guided to the first folding nip N1 along the first folding guide 104 and the second roller 112 (see FIG. 14). Next, the sheet S is stopped from being conveyed at such a position that a center thereof is opposed to the second folding nip N2 of the second folding roller pair 107. In this state, the second folding guide 108 is moved in a direction toward the second folding nip N2 so as to contact the sheet S, and thus the center of the sheet S is guided to the second folding nip N2 of the second folding roller pair 107. Thus, a fold line is formed on the sheet S that has passed through the second folding nip N2, so that a two-folding process is achieved.

Figure 12:
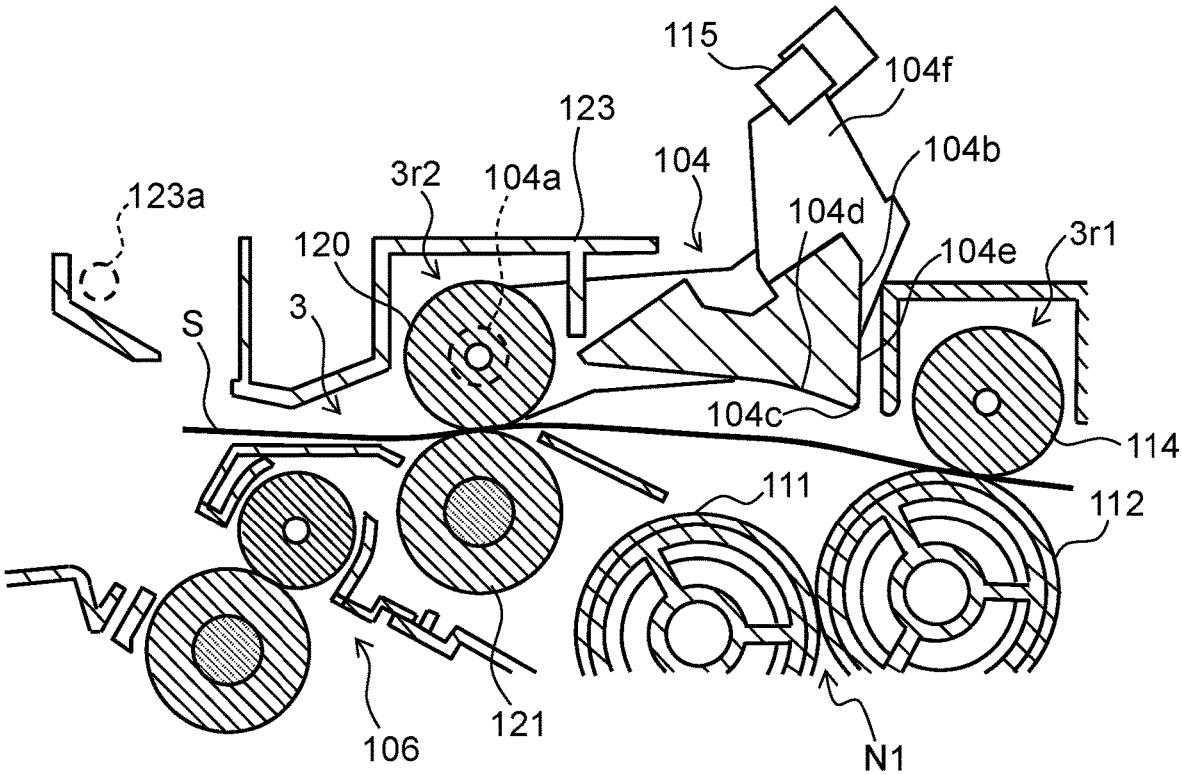
FIG. 12 is an enlarged sectional view of a vicinity of the first folding guide in the sheet folding unit, illustrating a state where the first folding guide is disposed at a retracted position.
Figure 13:
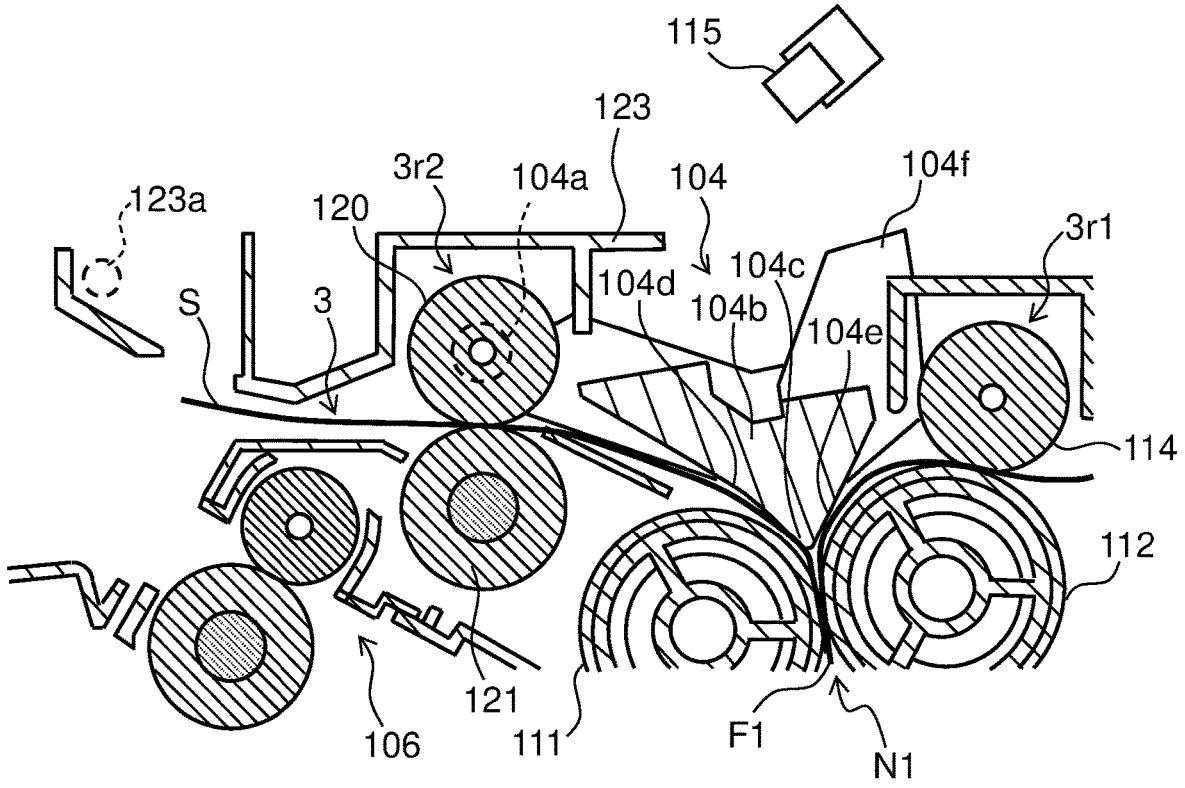
FIG. 13 is an enlarged sectional view of the vicinity of the first folding guide in the sheet folding unit, illustrating how the first folding guide is moved from the state shown in FIG. 12 to the folding position so as to guide a part of the sheet corresponding to a first fold line to the first folding nip.

FIG. 12 and FIG. 13 are enlarged views of a vicinity of the first folding guide 104 in the sheet folding unit 100, illustrating a state where the first folding guide 104 is disposed at the retracted position and a state where the first folding guide 104 is disposed at the folding position, respectively. As shown in FIG. 12, a pivot fulcrum 104*a* of the first folding guide 104 is disposed on a downstream side of the first folding nip N1 in the sheet conveyance direction on the first sheet conveyance path 3. To be more specific, the pivot fulcrum 104*a* of the first folding guide 104 is disposed substantially coaxially with a roller 120 that is an upper one of rollers constituting the second assist roller pair 3*r*2.

The first folding guide 104 includes a guide part 104*b* that has a shape of a letter V as seen sideways and is provided at a pivot end thereof. The guide part 104*b* includes a vertex 104*c*, a pair of inclined surfaces 104*d* and 104*e*, and a light-blocking plate 104*f*. Hereinafter, the inclined surfaces 104*d* and 104*e* as a pair are distinguished from each other by being referred to as a first guide surface 104*d* and a second guide surface 104*e*, respectively. As shown in FIG. 12, in a state where the first folding guide 104 is disposed at the retracted position, the first guide surface 104*d* functions as a conveyance guide that guides the sheet S downstream along the first sheet conveyance path 3.

Furthermore, as shown in FIG. 13, in a state where the first folding guide 104 is disposed at the folding position, the vertex 104*c* is in proximity to the first folding nip N1, and the first guide surface 104*d* and the second guide surface 104*e* are opposed to an outer circumferential surface of the first roller 111 and an outer circumferential surface of the second roller 112, respectively. The first folding guide 104 is caused to pivot in a clockwise direction from the state shown in FIG. 12 so as to be moved to the folding position, and thus the first guide surface 104*d* and the second guide surface 104*e* press the sheet S against the first roller 111 and the second roller 112, respectively, and guide a part of the sheet S corresponding to the first fold line F1 to the first folding nip N1.

Figure 14:
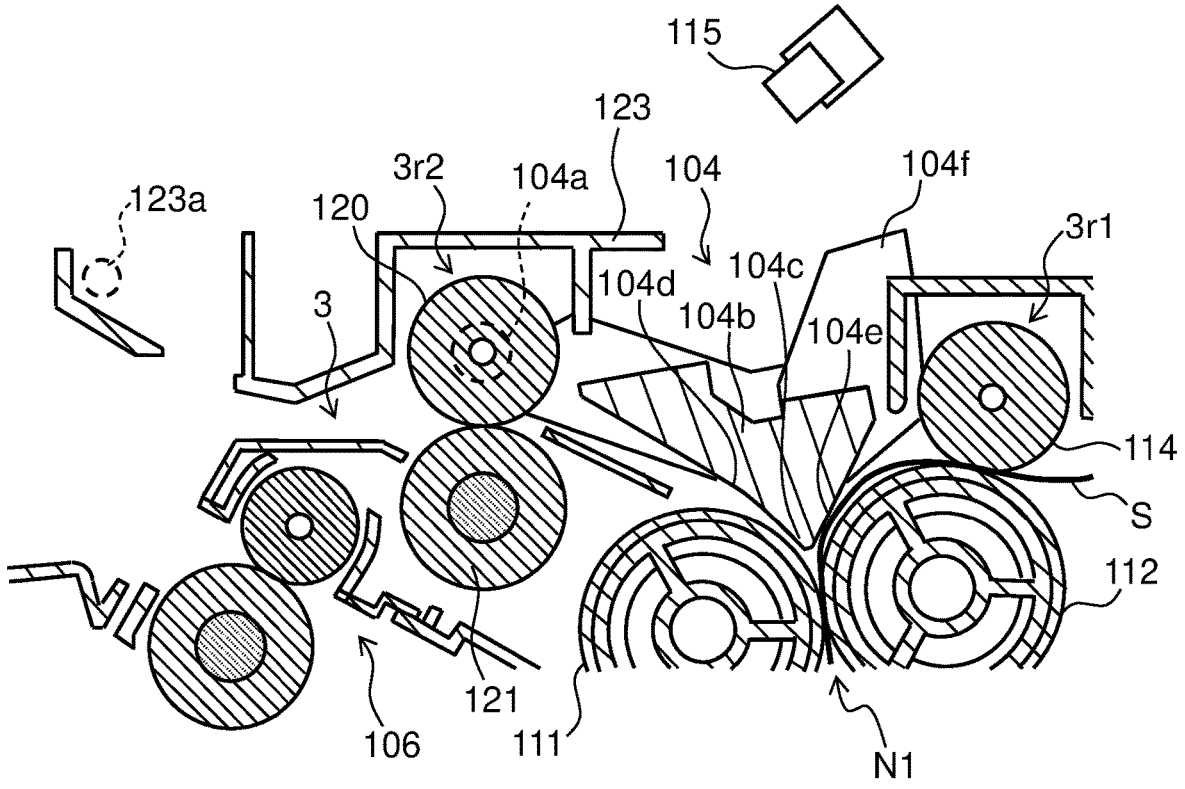
FIG. 14 is an enlarged sectional view of the vicinity of the first folding guide in the sheet folding unit, illustrating how the sheet is guided to a first folding conveyance path along a second guide surface of the first folding guide disposed at the folding position.

FIG. 14 is a view showing how, in the state where the first folding guide 104 is disposed at the folding position, the sheet S is guided to the first folding conveyance path 102 along the second guide surface 104*e*. In the case of folding the sheet S in two, in a state where the first folding guide 104 is disposed beforehand at the folding position, the sheet S is conveyed along the first sheet conveyance path 3. As a result, the sheet S that has passed through the first assist roller pair 3*r*1 is guided to the first folding conveyance path 102 along the second guide surface 104*e*. That is, in the case of folding the sheet S in two, the second guide surface 104*e* also has a function as a conveyance guide that guides the sheet S that is conveyed along the first sheet conveyance path 3 to the first folding conveyance path 102.

As the first folding guide 104 moves from the folding position to the retracted position, the light-blocking plate 104*f* brings a detector of a guide position detection sensor 115 that is a PI (photointerrupter) sensor from a light-transmitting state to a light-blocking state shown in FIG. 12. Furthermore, as the first folding guide 104 moves from the retracted position to the folding position, the light-blocking plate 104*f* brings the detector of the guide position detection sensor 115 from the light-blocking state to the light-transmitting state shown in FIG. 13. The post-processing control portion 10 performs control so that a guide drive motor 131 (see FIG. 15) is stopped from running after a lapse of a prescribed amount of time from a timing at which the guide position detection sensor 115 is brought from the light-transmitting state to the light-blocking state, and thus the first folding guide 104 is positioned at the retracted position. Furthermore, the post-processing control portion 10 performs control so that the guide drive motor 131 is stopped from running after a lapse of a prescribed amount of time from a timing at which the guide position detection sensor 115 is brought from the light-blocking state to the light-transmitting state, and thus the first folding guide 104 is positioned at the folding position.

A jam clearance guide 123 is disposed above the first folding guide 104. The jam clearance guide 123 is supported so as to be pivotable up and down about, as a fulcrum, a pivot shaft 123*a* on a downstream side in the sheet conveyance direction on the first sheet conveyance path 3. The jam clearance guide 123 is caused to pivot upward to open the first sheet conveyance path 3, thus allowing the sheet S jammed in the first sheet conveyance path 3 to be removed.

Furthermore, since the jam clearance guide 123 is opened in this manner, the first folding guide 104 is allowed to pivot to such a position as to open an area above the first folding nip N1 with respect to the first sheet conveyance path 3. Thus, an area above the first folding roller pair 103 is widely opened to facilitate removal of the sheet S jammed at the first folding nip N1.

Figure 15:
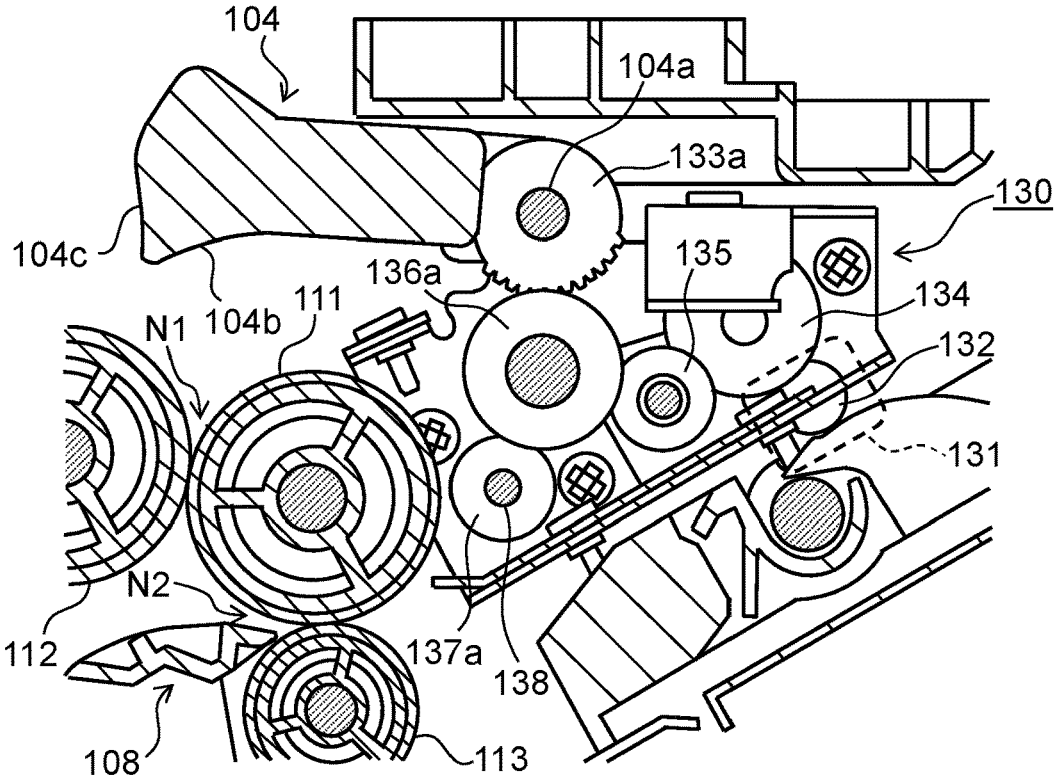
FIG. 15 is a sectional side view of a front part of the first folding guide including a guide drive mechanism.
Figure 16:
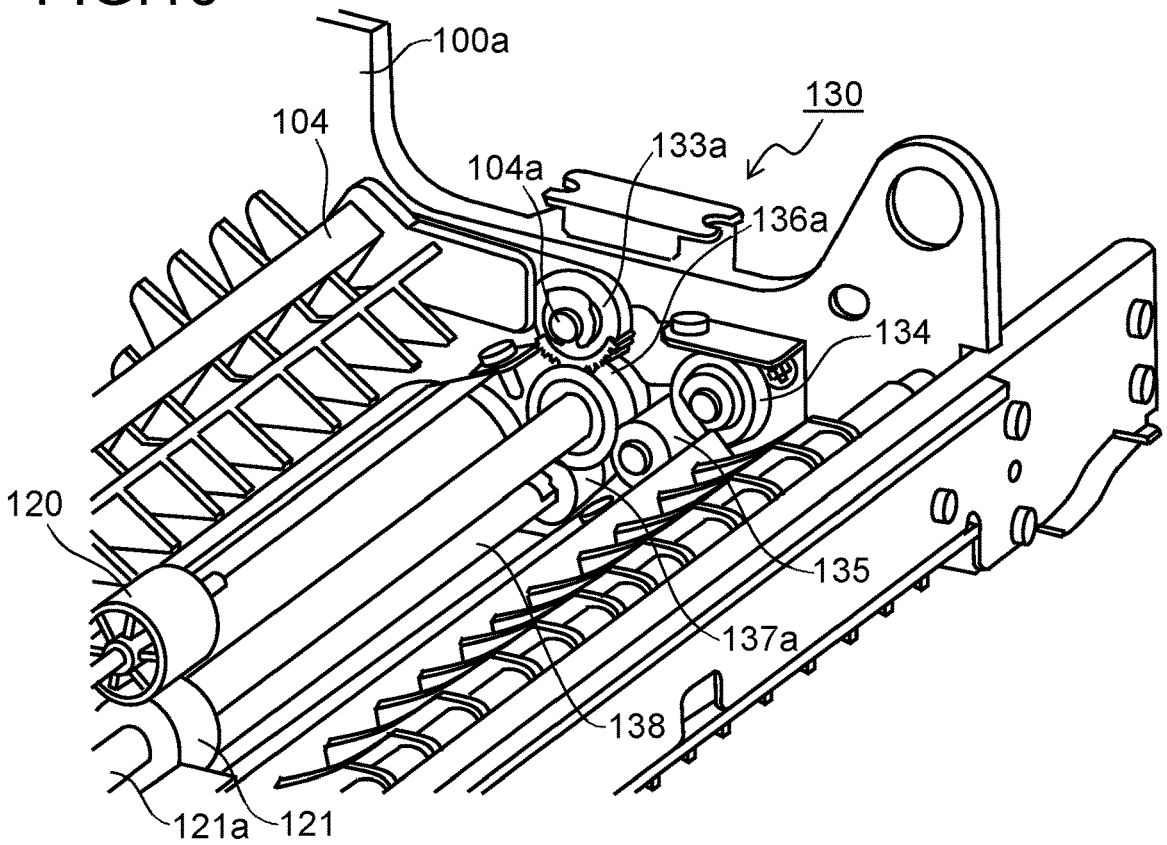
FIG. 16 is a perspective view, as seen from above, of a vicinity of the guide drive mechanism in the front part of the first folding guide.
Figure 17:
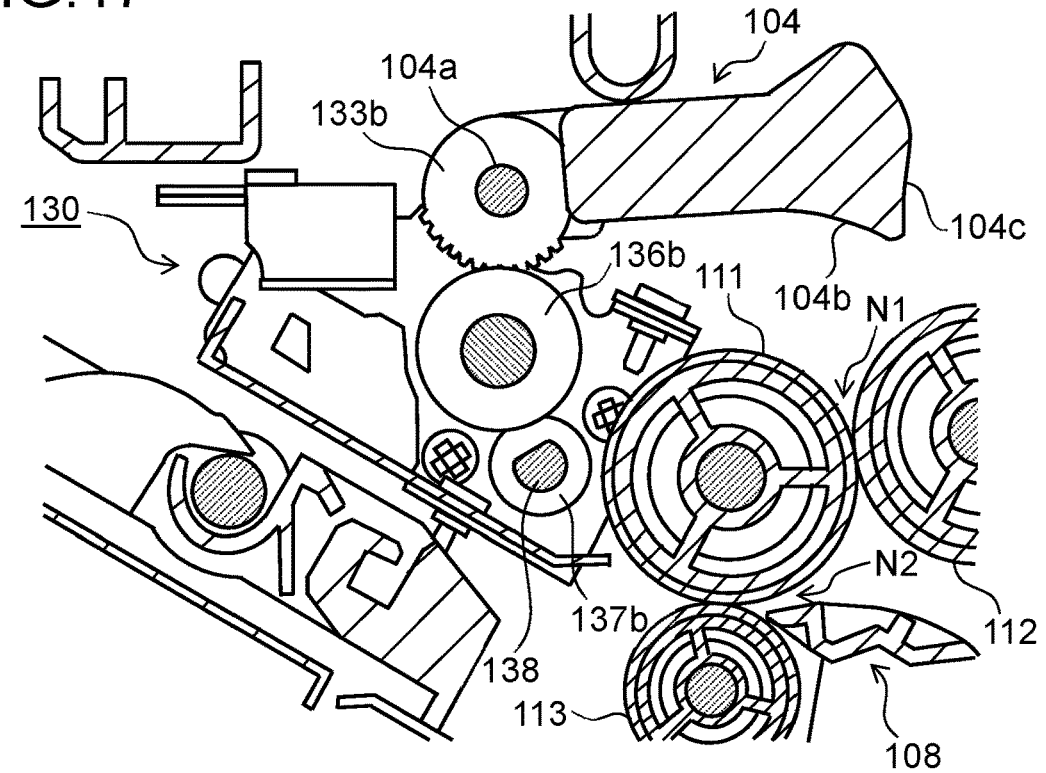
FIG. 17 is a sectional side view of a rear part of the first folding guide including the guide drive mechanism.
Figure 18:
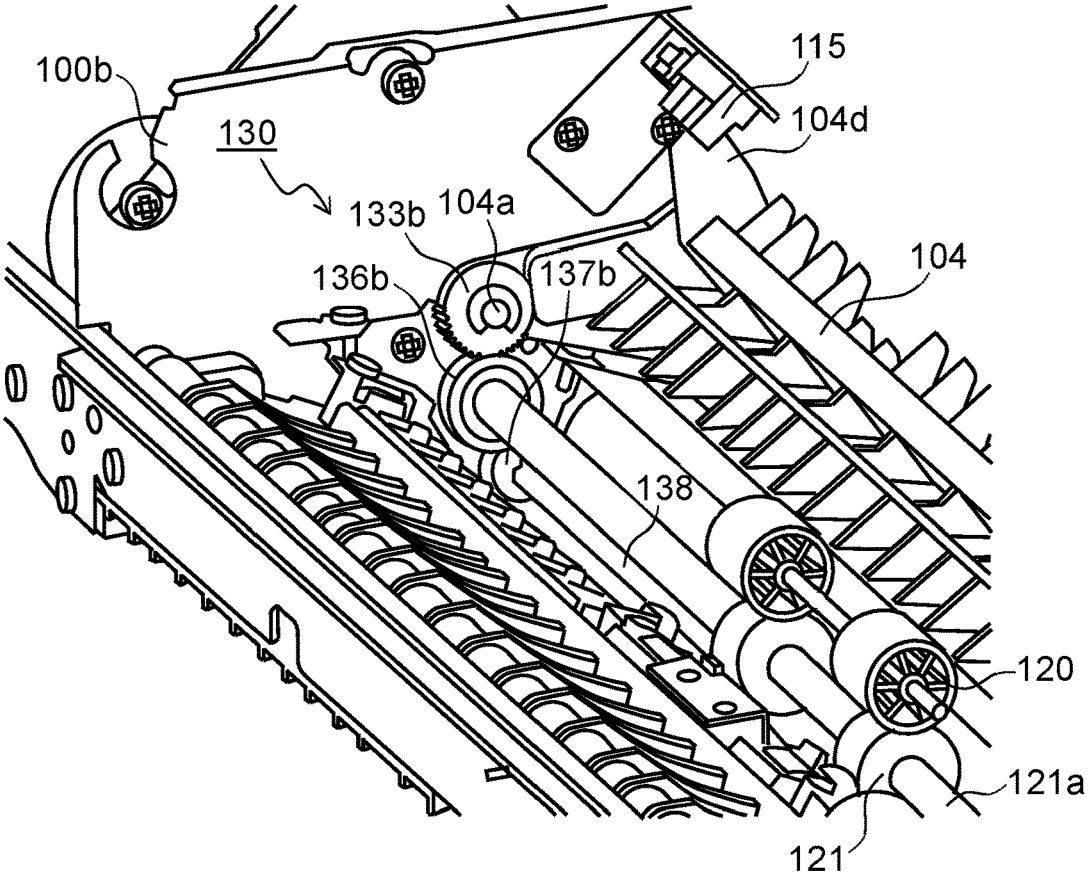
FIG. 18 is a perspective view, as seen from above, of a vicinity of the guide drive mechanism in the rear part of the first folding guide.

Next, a description is given of the guide drive mechanism 130 for the first folding guide 104. FIG. 15 is a sectional side view of a front part of the first folding guide 104 including the guide drive mechanism 130. FIG. 16 is a perspective view, as seen from above, of a vicinity of the guide drive mechanism 130 in the front part of the first folding guide 104. FIG. 17 is a sectional side view of a rear part of the first folding guide 104 including the guide drive mechanism 130. FIG. 18 is a perspective view, as seen from above, of a vicinity of the guide drive mechanism 130 in the rear part of the first folding guide 104.

The guide drive mechanism 130 includes a drive output gear 132 that is coupled to a drive shaft of the guide drive motor 131, drive input gears 133*a* and 133*b* that are secured to pivot fulcrums 104*a* of the first folding guide 104, a first drive transmission gear 134, a second drive transmission gear 135, third drive transmission gears 136*a* and 136*b*, fourth drive transmission gears 137*a* and 137*b*, and a drive transmission shaft 138. The first drive transmission gear 134, the second drive transmission gear 135, the third drive transmission gears 136*a* and 136*b*, and the fourth drive transmission gears 137*a* and 137*b* constitute gear trains coupling the drive output gear 132 to the drive input gears 133*a* and 133*b*.

As shown in FIG. 16 and FIG. 18, a pair of the pivot fulcrums 104*a* of the first folding guide 104 is swingably supported to a front frame 100*a* and a rear frame 100*b* of the sheet folding unit 100. The drive input gear 133*a* is secured to one of the pivot fulcrums 104*a* supported to the front frame 100*a*, and the drive input gear 133*b* is secured to the other of the pivot fulcrums 104*a* supported to the rear frame 100*b*. The drive input gears 133*a* and 133*b* are each an incompletely toothed gear having gear teeth formed only on a part of an outer circumferential surface thereof.

As shown in FIG. 15 and FIG. 17, the drive output gear 132 meshes with the first drive transmission gear 134, and the first drive transmission gear 134 meshes with the second drive transmission gear 135. The first drive transmission gear 134 and the second drive transmission gear 135 are idle gears and are disposed only in a front part of the sheet folding unit 100.

The third drive transmission gears 136*a* and 136*b* are idle gears disposed coaxially with a rotary shaft 121*a* of a roller 121 that is a lower one of the rollers constituting the second assist roller pair 3*r*2. The third drive transmission gears 136*a* and 136*b* are disposed in the front part and a rear part of the sheet folding unit 100, respectively. The third drive transmission gear 136*a* meshes with the drive input gear 133*a*, and the third drive transmission gear 136*b* meshes with the drive input gear 133*b*.

The fourth drive transmission gears 137*a* and 137*b* are secured respectively to both ends of the drive transmission shaft 138 extending along a front-rear direction of the sheet folding unit 100. The fourth drive transmission gear 137*a* meshes with the third drive transmission gear 136*a* in the front part of the sheet folding unit 100, and the fourth drive transmission gear 137*b* meshes with the third drive transmission gear 136*b* in the rear part of the sheet folding unit 100.

As shown in FIG. 15 and FIG. 16, a rotation drive force outputted from the guide drive motor 131 in one part (the front part) of the sheet folding unit 100 is transmitted from the drive output gear 132 to the drive input gear 133*a* via the first drive transmission gear 134, the second drive transmission gear 135, and the third drive transmission gear 136*a*. Furthermore, the third drive transmission gear 136*a* meshes with the fourth drive transmission gear 137*a*, and the rotation drive force outputted from the guide drive motor 131 is transmitted to the other part (the rear part) via the fourth drive transmission gear 137*a* and the drive transmission shaft 138.

As shown in FIG. 17 and FIG. 18, the rotation drive force transmitted to the other part (the rear part) of the sheet folding unit 100 via the drive transmission shaft 138 is transmitted to the third drive transmission gear 136*b* via the fourth drive transmission gear 137*b* and further to the drive input gear 133*b*.

When the guide drive motor 131 is rotated (rotated forwardly) so that the drive output gear 132 rotates forwardly (in a clockwise direction in FIG. 15), the drive input gears 133*a* and 133*b* rotate forwardly (in the clockwise direction in FIG. 15) via first drive transmission gear 134, the second drive transmission gear 135, the third drive transmission gears 136*a* and 136*b*, and the fourth drive transmission gears 137*a* and 137*b*, causing the first folding guide 104 to pivot in a direction away from the first folding nip N1.

Then, when a prescribed amount of time has elapsed from the timing at which the guide position detection sensor 115 (see FIG. 13) is brought from the light-transmitting state to the light-blocking state by the light-blocking plate 104*f*, the guide drive motor 131 is stopped from rotating, and the first folding guide 104 also stops pivoting. As a result, the first folding guide 104 is disposed at the retracted position (see FIG. 12).

When, on the other hand, the guide drive motor 131 is rotated (rotated reversely) so that the drive output gear 132 rotates reversely (in a counterclockwise direction in FIG. 15), the drive input gears 133*a* and 133*b* rotate reversely (in the counterclockwise direction in FIG. 15) via the first drive transmission gear 134, the second drive transmission gear 135, the third drive transmission gears 136*a* and 136*b*, and the fourth drive transmission gears 137*a* and 137*b*, causing the first folding guide 104 to pivot in a direction toward the first folding nip N1.

Then, when a prescribed amount of time has elapsed from the timing at which the guide position detection sensor 115 is brought from the light-blocking state to the light-transmitting state, the guide drive motor 131 is stopped from rotating, and the first folding guide 104 also stops pivoting. As a result, the first folding guide 104 is disposed at the folding position (see FIG. 13 and FIG. 14).

According to the above-described configuration, the pivot fulcrums 104*a* of the first folding guide 104 are disposed on a downstream side of the first folding nip N1 in the sheet conveyance direction on the first sheet conveyance path 3. Thus, unlike in a case where the pivot fulcrums 104*a* are disposed on an upstream side of the first folding nip N1 in the sheet conveyance direction, it is not required to increase a diameter of the second roller 112 or to add a new conveyance roller pair in place of the first assist roller pair 3*r*1 so as to place the pivot fulcrums 104*a* at an increased distance from the first folding nip N1, so that it is possible to achieve reductions in device size and number of components used.

Furthermore, when the first folding guide 104 is disposed at the retracted position, the first guide surface 104*d* guides the sheet S along the first sheet conveyance path 3. When, on the other hand, the first folding guide 104 is disposed at the folding position, the second guide surface 104*e* guides the sheet S from the first sheet conveyance path 3 to the first folding conveyance path 102. Thus, it is not required to separately provide conveyance guides for conveying the sheet S along the first sheet conveyance path 3 and along the first folding conveyance path 102, so that it is possible to achieve a reduction in number of components used.

Furthermore, the sheet folding unit 100 configured as above is used to perform a folding process including a step (see FIG. 6) of forwardly rotating the first assist roller pair 3*r*1 and the second assist roller pair 3*r*2 to convey the sheet S in a conveyance direction so that a part of the sheet S corresponding to a fold line is opposed to the first folding nip N1, a step (see FIG. 7) of reversely rotating the second assist roller pair 3*r*2 while the first assist roller pair 3*r*1 is stopped from rotating, thus forming a deflection in the sheet S, and a step (see FIG. 8) of moving, after a lapse of a prescribed amount of time from a start of reverse rotation of the second assist roller pair 3*r*2, the first folding guide 104 to the folding position so that a to-be-folded part of the sheet S is guided to the first folding nip N1 and is passed through the first folding nip N1, and thus the folding process can be performed smoothly with respect to the sheet S without causing wrinkle formation in the sheet S or breakage of the sheet S.

While the foregoing has described the embodiment of the present disclosure, the present disclosure is not limited in scope thereto and can be implemented by adding various modifications thereto without departing from the spirit of the disclosure. For example, while the foregoing embodiment has shown an example in which the sheet folding unit 100 includes the first folding roller pair 103 and the second folding roller pair 107 composed of three rollers that are the first to third rollers 111 to 113, the present disclosure is not limited thereto and may also be configured so that the sheet folding unit 100 includes only the first folding roller pair 103 composed of the first roller 111 and the second roller 112.

Furthermore, while the foregoing embodiment has a configuration in which the guide drive mechanism 130 includes the first drive transmission gear 134, the second drive transmission gear 135, the third drive transmission gears 136*a* and 136*b*, and the fourth drive transmission gears 137*a* and 137*b*, and the fourth drive transmission gears 137*a* and 137*b* as a pair are secured respectively to the both ends of the drive transmission shaft 138, any number of drive transmission gears can be used. That is, it is only required that, between the drive output gear 132 and the drive input gears 133*a* and 133*b*, a pair of drive transmission gears be disposed to be secured to the both ends of the drive transmission shaft 138 so that a drive force can be transmitted at one time to the drive input gears 133*a* and 133*b* secured to the pair of pivot fulcrums 104*a* of the first folding guide 104.

The present disclosure is usable in a sheet folding device that performs a folding process of forming a fold line on a sheet and in a sheet post-processor provided with the sheet folding device.

What is claimed is:

1. A sheet folding device that performs a folding process with respect to a sheet, comprising:

a sheet conveyance path on which the sheet is conveyed;

a first folding conveyance path that extends to intersect with the sheet conveyance path;

a first folding roller pair that is composed of:

a first roller; and a second roller configured to form a first folding nip by being brought into pressure contact with an upstream side of the first roller in a conveyance direction of the sheet conveyed on the sheet conveyance path, the first folding roller pair being configured to fold in two the sheet passing through the first folding nip and to convey the sheet to the first folding conveyance path;

a first folding guide that is disposed to be opposed to the first folding nip with the sheet conveyance path interposed therebetween and reciprocates between a folding position at which the first folding guide approaches the first folding nip to guide a to-be-folded part of the sheet conveyed on the sheet conveyance path to the first folding nip and a retracted position at which the first folding guide is away from the first folding nip; and a conveyance roller that makes pressure contact with the second roller so as to form, together with the second roller, a first assist roller pair that conveys the sheet along the sheet conveyance path, wherein the first folding guide has a pivot fulcrum on a downstream side relative to the first folding nip in the conveyance direction and is supported so as to be pivotable about the pivot fulcrum between the folding position and the retracted position, the sheet folding device further includes a jam clearance guide that is capable of opening and closing the sheet conveyance path to remove the sheet, and in a state where the jam clearance guide is opened, the first folding guide is pivotable to such a position as to open an area above the first folding nip with respect to the sheet conveyance path.

2. The sheet folding device according to claim 1, wherein the first folding guide includes a guide part that has a shape of a letter V as seen sideways and is provided at a pivot end thereof, and the guide part includes a vertex and a pair of inclined surfaces extending from the vertex, when the first folding guide is disposed at the folding position after a front end of the sheet passes above the first folding nip, the vertex comes into contact with the to-be-folded part of the sheet conveyed on the sheet conveyance path and guides the to-be-folded part to the first folding nip, and the pair of inclined surfaces includes:

a first guide surface that, when the first folding guide is disposed at the retracted position, is disposed to be opposed to the first folding nip and guides the sheet downstream on the sheet conveyance path; and a second guide surface that, when the first folding guide is disposed at the folding position before the front end of the sheet reaches above the first folding nip, is opposed to an outer circumferential surface of the second roller and guides the front end of the sheet to the first folding conveyance path.

3. A sheet post-processor, comprising:

a sheet conveyance inlet that is provided in a side surface of the sheet post-processor opposed to an image forming apparatus and into which a sheet with an image formed thereon is conveyed;

the sheet folding device according to claim 1, which performs a prescribed folding process with respect to the sheet;

a sheet discharge portion to which the sheet that has been subjected to the folding process is discharged; and a control portion that controls the folding process performed by the sheet folding device.

4. The sheet post-processor according to claim 3, wherein the sheet folding device includes:

a second folding roller pair that is composed of:

the first roller; and a third roller that makes pressure contact with the first roller so as to form a second folding nip, the second folding roller pair being configured to pass the sheet through the second folding nip so as to fold the sheet in two and to convey the sheet to a second folding conveyance path intersecting with the first folding conveyance path; and a second folding guide that is disposed to be opposed to the second folding nip and guides the to-be-folded part of the sheet that is conveyed on the first folding conveyance path to the second folding nip, and the to-be-folded part of the sheet includes a first to-be-folded part and a second to-be-folded part on the rear end side of the first to-be-folded part, the control portion subjects the sheet to a three-folding process by passing the first to-be-folded part through the first folding nip and the second to-be-folded part through the second folding nip in this order.

5. The sheet post-processor according to claim 4, wherein the to-be-folded part is set on a center of the sheet in the conveying direction, the control portion performs a two-folding process including:

a step in which, in a state where the first folding guide is disposed at the folding position, the first assist roller pair is rotated forwardly so that the sheet is conveyed to the first folding nip between the first folding guide and the second roller and so that the to-be-folded part of the sheet that has passed through the first folding nip is opposed to the second folding nip; and a step in which the second folding guide is moved in a direction toward the second folding nip so as to contact the sheet, and thus the to-be-folded part of the sheet is guided to the second folding nip and is passed through the second folding nip.

6. The sheet post-processor according to claim 3, wherein the sheet folding device further includes:

a second assist roller pair that is disposed on a downstream side relative to the first folding nip in the conveyance direction on the sheet conveyance path, and the control portion performs a folding process including:

a step in which the first assist roller pair and the second assist roller pair are rotated forwardly to convey the sheet in the conveyance direction so that the to-be-folded part of the sheet is opposed to the first folding nip;

a step in which, in a state where the first assist roller pair is stopped from rotating, the second assist roller pair is rotated reversely so as to form a deflection in the sheet; and a step in which, after a lapse of a prescribed amount of time from a start of reverse rotation of the second assist roller pair, the first folding guide is moved to the folding position so that the to-be-folded part of the sheet is guided to the first folding nip and is passed through the first folding nip.

* * * * *